United States Patent [19]

Straube

[11] 4,090,703

[45] May 23, 1978

[54] FEEDING APPARATUS FOR SHEET MATERIAL

[75] Inventor: Peter Jon Straube, Hastings, Mich.

[73] Assignee: Gulf & Western Manufacturing Company, Southfield, Mich.

[21] Appl. No.: 765,980

[22] Filed: Feb. 7, 1977

[51] Int. Cl.[2] ..... B65H 5/16; B65H 9/10

[52] U.S. Cl. ..... 271/233; 83/156; 83/418; 271/238; 271/266; 271/269; 271/271; 271/273

[58] Field of Search ..... 271/233, 269, 271, 234, 271/236, 238, 240, 250, 266, 273; 83/112, 156, 418

[56] References Cited

U.S. PATENT DOCUMENTS

| | | | |
|---|---|---|---|
| 2,039,699 | 5/1936 | Biazzi | 271/266 |
| 2,273,823 | 2/1942 | Ayres | 271/233 |
| 3,245,683 | 4/1966 | Nordquist | 271/271 X |
| 3,854,315 | 12/1974 | Winkler | 271/250 X |

FOREIGN PATENT DOCUMENTS

| | | | |
|---|---|---|---|
| 120,438 | 10/1945 | Australia | 83/268 |
| 242,388 | 1/1963 | Australia | 271/266 |

*Primary Examiner*—Bruce H. Stoner, Jr.

*Attorney, Agent, or Firm*—Meyer, Tilberry & Body

[57] ABSTRACT

Apparatus is disclosed for feeding rectangular metal sheets from a supply to a cupping press in which can body blanks are cut and drawn from the metal sheets. The apparatus includes a table providing a flat conveying surface, and three sheet feeding mechanisms are provided at locations along the table between the opposite ends thereof. A sheet to be transferred is deposited on one end of the table and is transferred therefrom to a second position by an endless chain and feed finger arrangement. At the second position, the trailing edge of the sheet is engaged by a reciprocating feed finger arrangement to advance the sheet one step to a third position on the table in which the sheet is accurately spaced longitudinally relative to a reference point in the press. In the third position, the sheet is also laterally positioned with respect to the reference point, and the trailing edge of the sheet is engaged by the first of a series of reciprocating feed fingers which are operable to intermittently advance the sheet through the press. Following the last blanking operation, the leading edge of the sheet is engaged between a pair of discharge rollers by which the remaining scrap is removed from the press.

12 Claims, 14 Drawing Figures

P
C
A
H2
12
12
S3
S2
T3
H1
T2
T1
S1
S
3
3
D
B
138
22
142
144

C
144
142
T1
B
S3
T3
S1
S
T2
S2
T3
P
D
G
T1
A

FIG. 6
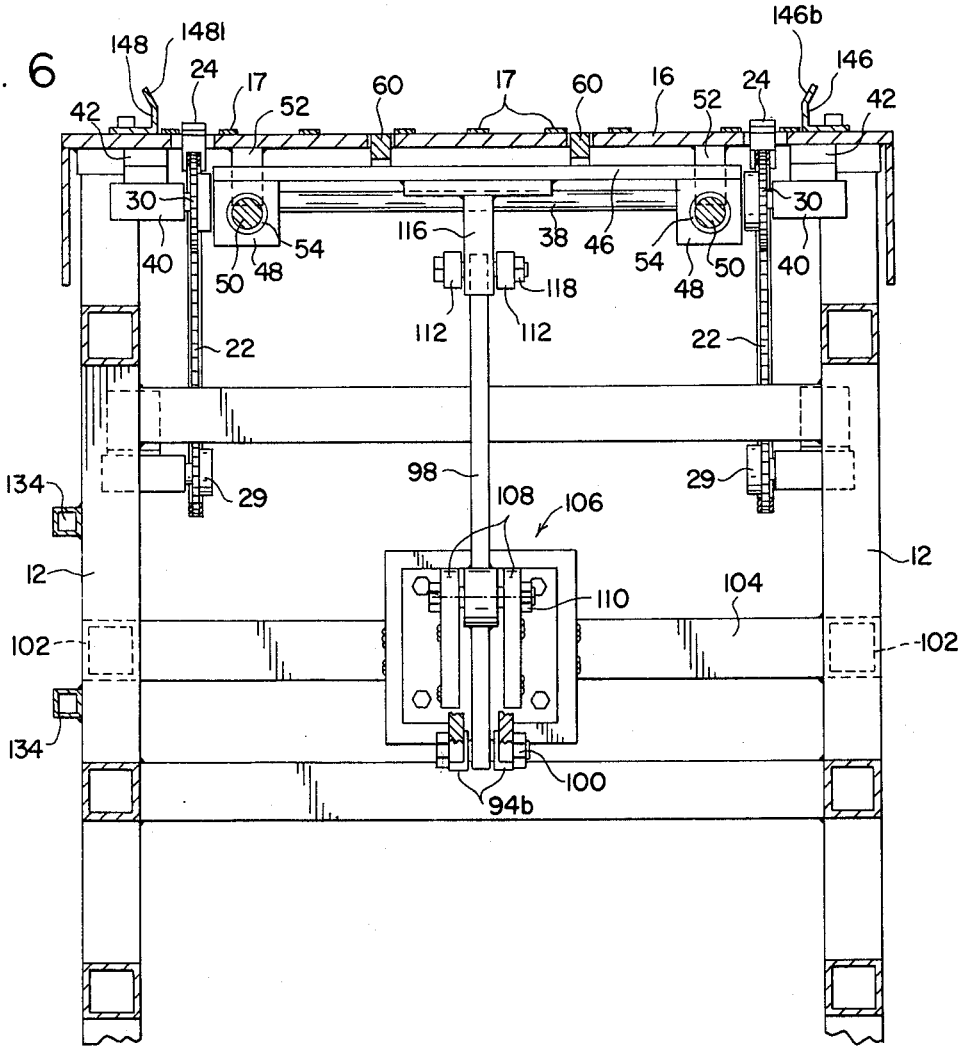
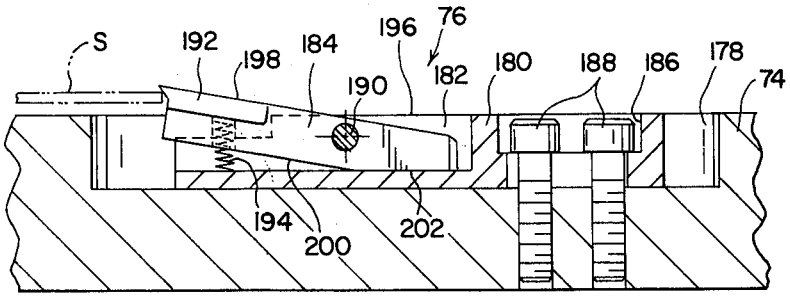
FIG. 9
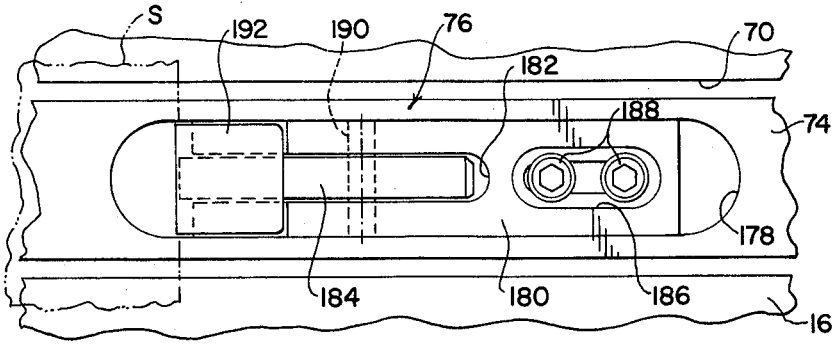
FIG. 10

FEEDING APPARATUS FOR SHEET MATERIAL

BRIEF SUMMARY OF THE INVENTION

This invention relates to the art of sheet metal transfer mechanisms and, more particularly, to a mechanism for feeding rectangular metal sheets to a metalworking press.

The present invention finds particular utility in connection with the transfer of metal sheets to a cupping press in which cup-shaped metal can body blanks are produced. Accordingly, the invention will be described in detail in conjunction with such a press. It will be apparent from the description, however, that the invention is applicable to the transfer of sheet material other than metal and to the transfer of sheet material other than to a press.

In connection with the production of seamless can bodies of metal such as aluminum or steel, a metal sheet is first transferred through a cupping press in which shallow cup-shaped blanks are produced. Often, such a cupping press is part of a production line including a can body drawing press to which the cup-shaped blanks are delivered for drawing and ironing to the desired can body configuration. The production of seamless can bodies of aluminum or steel is relatively expensive and, accordingly, acceptance of machinery for producing the can bodies depends in part on the production rate obtainable therewith. A can body drawing and ironing press, such as that shown in U.S. Pat. No. 3,889,509 having a dual ironing ring and ram arrangement, has a relatively high production rate capability. It will be appreciated that the output capability of the ironing press can only be realized if cup-shaped blanks are delivered thereto at a rate corresponding to the production rate of the ironing press.

The cup-shaped can body blanks are generally produced in a press employing a multiple die set which facilitates the cutting and die shaping of a plurality of blanks during each stroke of the press. The number of cup-shaped blanks which can be produced during each stroke of the press of course depends on the size of the press. Additionally, the rate of output from the cupping press is determined in part by the stroke rate of the press, and the stroke rate is dependent in part on the speed at which the material to be blanked can be fed to the press and aligned with respect to the press die components.

Alignment of the sheet material with the die components to achieve maximum consumption of the sheet material has been a problem heretofore requiring a slow down of the optimum stroke rate of the blanking press to allow time to achieve alignment. In this respect, alignment procedures heretofore have required stop gauges and back-up devices in the press to facilitate forward and reverse displacement of the sheet material to achieve the desired positioning thereof. The sheet material transfer and alignment procedure must of course take place during the return and advance portions of the press slide stroke when the die components are separated, and the stroke speed often has to be decreased to provide sufficient time for the feed and alignment procedure. This of course reduces the output rate of the cupping press and increases the cost of producing can body blanks.

Other alignment procedures do not depend on accuracy of alignment but rather provide for sufficient displacement of the sheet material between strokes to assure avoiding an overlap of the blanks cut during succeeding strokes of the press. While such an arrangement enables the press to operate at a higher press stroke rate, a considerable amount of scrap material is left between adjacent cuttings. This of course is economically inefficient and additionally provides problems with respect to scrap disposal, all of which increase the cost of producing the can body blanks.

Since it is economically impractical to increase the size of the blanking press merely to enable increasing the number of blanks which can be produced during each stroke of the press, the foregoing problems make it highly desirable to provide a material feeding arrangement which, for a given size press, will enable operation of the press at the optimum stroke rate thereof and with maximum consumption of the material from which the blanks are cut. These desirable results are achieved in accordance with the present invention by the provision of a sheet material feed mechanism which enables achieving accurate alignment of a rectangular sheet relative to the press die components before the sheet enters the press and independent of any stops and/or back-up devices heretofore required to achieve proper positioning.

More particularly in accordance with the present invention, a rectangular metal sheet to be blanked is initially delivered onto a transfer table from a source such as a stack of metal sheets and is transferred toward the press a distance corresponding to the length of the sheet in the latter direction by an endless conveyor feed arrangement including feed fingers engaging the trailing edge of the sheet to displace the sheet along the transfer table surface. During this movement a portion of the sheet from the leading edge toward the trailing edge engages beneath a spring biased hold down arrangement by which the sheet is held against the table by a predetermined and adjustable pressure. The endless conveyor transfer arrangement enables the sheet to be easily moved from the received position without depending on the accuracy with which the sheet is deposited on the table from the stack. When the sheet is advanced along the table to the position determined by the endless conveyor feed finger unit, the trailing edge of the sheet is engaged by a reciprocating feed finger unit which operates as an intermediate feed unit to advance the sheet toward the press an accurately controlled distance so as to accurately position the sheet longitudinally relative to die components in the press. Further, the sheet is laterally engaged between guides at this time, whereby the sheet is both laterally and longitudinally aligned with respect to the die components of the press.

When the sheet is laterally and longitudinally aligned in the above manner, the third feed unit operates to intermittently advance the sheet through the press. More particularly, the third feed unit is a reciprocating feed finger unit comprised of a plurality of feed fingers accurately spaced apart longitudinally a distance which assures proper positioning of an uncut portion of the sheet relative to the press die components with minimum scrap material between succeeding areas of the sheet from which blanks are cut in the press. Each time the third feed unit reciprocates back and forth, a new set of feed fingers engages the trailing edge of the sheet so as to accurately advance the sheet step by step through the press. The hold down arrangement applies sufficient pressure against the sheet to enable movement of the feed fingers rearwardly of the sheet without the frictional engagement therebetween causing any rearward movement of the sheet. This advantageously enables maintaining the desired alignment and accurate step by step advancement of the sheet without the use of gripping devices, stop gauges or back up devices. Moreover, this enables higher speed feeding than can be achieved when such devices are required. When the trailing edge of the sheet being blanked reaches a predetermined location in the direction of feed, another sheet is delivered to the table by the de-stacker, is advanced to the intermediate feeder by the endless conveyor and feed finger unit, and is longitudinally aligned by the intermediate feed finger unit and laterally aligned in readiness for intermittent advancement by the third feed finger unit.

In accordance with another aspect of the present invention, the scrap material is quickly removed from the press by a pair of rollers operable to receive the leading edge of the scrap material therebetween and to discharge the scrap material from the press.

Operation of the endless conveyor and feed finger unit, the intermediate feed finger unit and the third feed unit is continuous and coordinated with the press stroke. The three feed units preferably have a common drive arrangement and additionally are preferably driven through a timing belt from the press to assure coordination of sheet transfer with the press stroke. Preferably, a suitable position detector is employed to respond to the position of the sheet being advanced through the press to initiate delivery of the sheet by the de-stacker when the trailing edge of the sheet being transferred to the press reaches a location which assures that the leading edge of the next sheet will be positioned relative to the trailing edge of the preceding sheet such that the blanking operation with regard to succeeding sheets is uninterrupted.

Accordingly, it is an outstanding object of the present invention to provide improved sheet feeding apparatus for advancing rectangular sheet material toward and through a work station and in accurate alignment with a tool or tools located at the work station.

Another object is the provision of sheet feeding apparatus of the foregoing character which enables sheet material deposited thereon to be quickly advanced to an aligning station, longitudinally laterally aligned with respect to the work station, and then accurately advanced step by step through the work station.

A further object is the provision of sheet feeding apparatus of the foregoing character wherein longitudinal alignment of a sheet with respect to the work station prior to and during movement of the sheet through the work station is achieved independent of any mechanical register stop and/or pull back devices.

Still a further object is the provision of sheet feeding apparatus of the foregoing character in which a sheet is preliminarily aligned longitudinally with respect to the work station by a first reciprocating feed finger unit, is laterally aligned with respect to the work station, and is thereafter advanced accurately step by step with respect to the work station by a second reciprocating feed finger unit.

Yet another object is the provision of sheet feeding apparatus of the foregoing character for feeding sheet material to a reciprocating press and which enables operating the press at an optimum stroke rate while maintaining accuracy of alignment of the sheet with respect to die components of the press and maximizing material consumption with respect to blanks cut from the sheet during intermittent movement thereof through the press.

Still a further object is the provision of sheet feeding apparatus of the foregoing character which enables the placement of a sheet on the apparatus from a supply source independent of accuracy of delivery from the supply source, rapid advancement of the sheet by an endless feed finger arrangement to a preliminary positioning station, longitudinal and lateral alignment at the positioning station respectively by a one step feed bar unit and a laterally displaceable guide unit, and accurate step by step advancement from the preliminary positioning station by a reciprocating feed finger unit operating independent of any stop gauges and/or pull back devices.

Still a further object is the provision of sheet feeding apparatus of the foregoing character which is structurally simple and highly efficient in operation and which enables high speed feeding of sheet material to a work station while maintaining desired accuracy in alignment relative to the work station and minimum wastage or scrap material with respect to the circular blanks cut from the sheet material.

The foregoing objects, and others, will in part be obvious and in part pointed out more fully hereinafter in conjunction with the written description of a preferred embodiment in the invention illustrated in the accompanying drawings in which:

FIG. 6 is a cross-sectional view of the apparatus taken along line 6—6 in FIG. 4;

FIG. 9 is a detailed sectional elevation view of a feed finger of the reciprocating feed finger units of the apparatus;

FIG. 10 is a plan view of the feed finger shown in FIG. 9;

Figure 1:
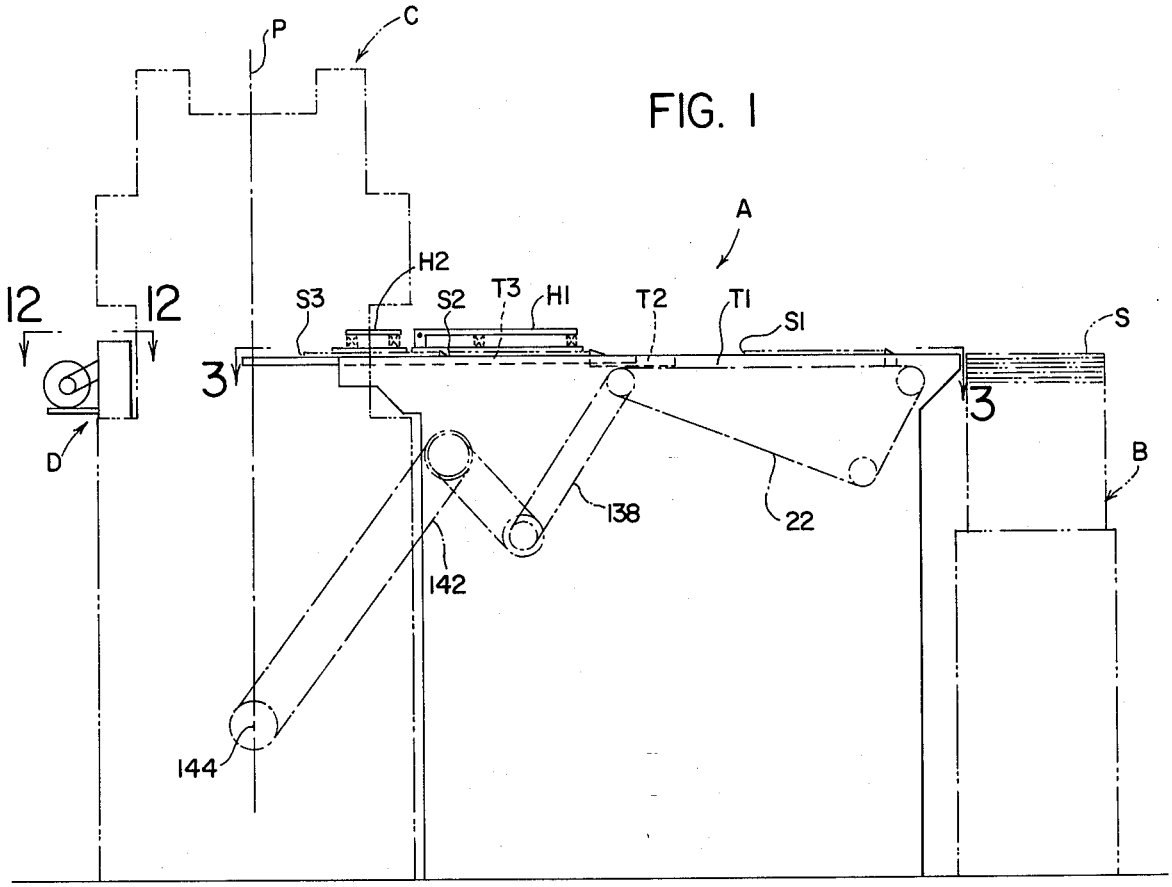
FIG. 1 is a schematic side elevation view of sheet transfer apparatus in accordance with the present invention associated with a metalworking press.
Figure 2:
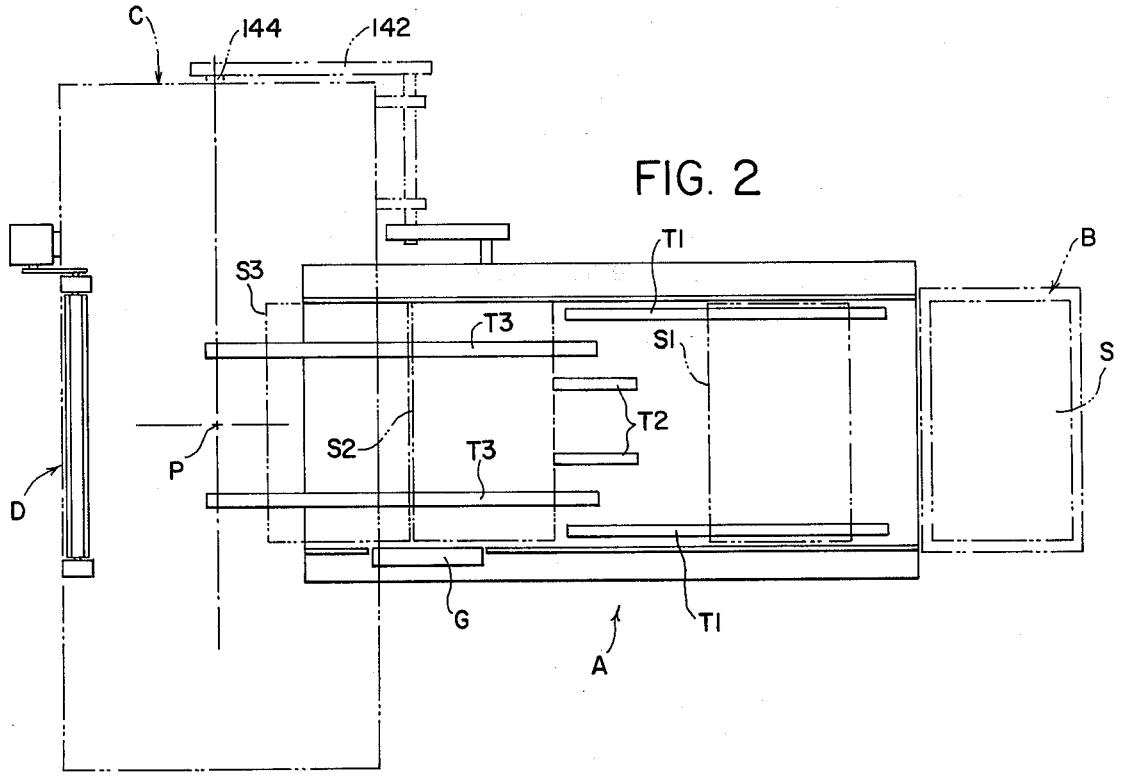
FIG. 2 is a schematic plan view of the apparatus and press.

Referring now in greater detail to the drawings wherein the showings are for the purpose of illustrating a preferred embodiment of the invention only and not for the purpose of limiting the invention, FIGS. 1 and 2 schematically illustrate a sheet metal transfer table A which is adapted to receive a metal sheet S on one end thereof from a stack B and to transfer the sheet to and through a reciprocating press C and thence to a discharge unit D by which metal scrap is removed from the press following the blanking operation. Generally, the metal sheets S in stack B are displaced therefrom onto the corresponding end of table A by de-stacker mechanism, not shown. Such mechanisms are well known for this purpose, and the structure and operation thereof is not important to the present invention and accordingly is not disclosed in detail. Likewise, the structure and operation of press C is not essential to provide an understanding of the present invention and accordingly is not shown in detail. It is only necessary in connection with the press to appreciate that the latter provides a work station at which blanks are cut from the metal sheet being transferred therethrough, and that the work station has a reference point P such as the vertical center line of the press which provides a basis for alignment and guidance of a metal sheet to be transferred through the press.

As will become apparent from the ensuing detailed description of a transfer table A and discharge unit D, a metal sheet S is deposited in a first position on the end of table A adjacent stack B. The leading edge of the sheet in the first position is designated S1, and the sheet is initially transferred by an endless chain and feed finger unit T1 to a second position in which the leading edge is designated S2. In the second position, a portion of the sheet is disposed beneath a first hold down assembly H1, and the trailing edge of the sheet is engaged by a first reciprocating feed finger unit T2 and the sheet is advanced one step thereby to a third position. In the third position, in which the leading edge of the sheet is designated by the letter S3, the leading end of the sheet moves under a second hold down assembly H2. The stroke of transfer unit T2 longitudinally aligns the metal sheet with respect to reference point P of the press, and while the sheet is in the third position a laterally displaceable side guide unit G is actuated to laterally align the sheet with respect to reference point P. From the third position, the sheet is intermittently advanced in equal steps through the press by a second reciprocating feed finger unit T3 so that a succession of blanks are cut from the sheet. The last step of feed unit T3 positions the leading edge of the sheet between a pair of rollers of discharge unit D which, as described hereinafter, operates to quickly remove the scrap sheet from the press.

Transfer table A is shown in detail in FIGS. 3–8. With regard to the latter Figures, it will be seen that table A includes pairs of vertical legs 10, 12 and 14 which support a table plate 16 along which the metal sheets are transferred and which plate is welded or otherwise suitably secured to the support legs. Table A has an input end 18 adjacent the supply stack and an output end 20 which is disposed adjacent the press. Endless chain and feed finger transfer mechanism T1 is mounted on the table beneath plate 16 adjacent input end 18 of the table and includes a pair of endless chains 22 provided with feed fingers 24. More particularly, table plate 16 is provided with longitudinally extending openings 26 along opposite sides of the table plate, and front and rear sprocket wheels 28 and 30, respectively, are rotatably supported adjacent the front and rear ends of openings 26.

Each of the front sprocket wheels 28 is mounted on a corresponding short shaft 32 received in a bearing sleeve support block 34 mounted on the under side of table plate 16 by means of a corresponding support bracket 36. Rear sprocket wheels 30 are mounted on a common shaft 38 having its opposite ends received in corresponding bearing sleeve support blocks 40 mounted on the under side of table plate 16 by means of support brackets 42. The outer end of one of the shafts 32 of front sprocket wheels 28 is provided with a drive sprocket wheel 44 by which the endless chain and feed finger mechanism is driven, as set forth more fully hereinafter. Each of the endless chains 22 is trained about the corresponding pair of sprocket wheels 28 and 30, and an idler wheel 29 therebeneath, and fingers 24 project upwardly through openings 26 to engage the trailing edge of a sheet S placed on the input end of the table. Thus, the sheet is adapted to be displaced toward discharge end 20 of the table a distance corresponding to the horizontal run of the chains. It will be appreciated of course that feed fingers 24 on the two chains are generally aligned laterally of the table for engagement with the trailing edge of a sheet placed on the input end of the table. It will be further appreciated that rotation of drive sprocket wheel 44 imparts rotation to both pairs of sprocket wheels 28 and 30 through endless chains 22 and the common shaft 38 for rear sprocket wheels 30.

Reciprocating feed finger unit T2 is adapted to engage the rear edge of a sheet S advanced forwardly of the table by feed mechanism T1 and to advance the sheet a single short step in the direction towards discharge end 20 of the table. For this purpose, feed unit T2 includes a support plate 46 extending laterally of the table beneath table plate 16 and parallel thereto. Laterally opposite sides of support plate 46 are bolted or otherwise suitably attached to bearing support blocks 48 which are longitudinally apertured to receive guide rods 50 which are mounted on the under side of table plate 16 by means of a plurality of corresponding mounting brackets 52. Preferably, bearing sleeves 54 are interposed between bearing blocks 48 and guide rods 50 to facilitate sliding movement of the bearing blocks and support plate 46 relative to the guide rods.

Table plate 16 is provided with longitudinally extending openings 56 and 58, and feed bars 60 are bolted or otherwise mounted on the top of support plate 46 so as to extend upwardly through the corresponding openings 56 and 58. Each feed bar 60 carries a corresponding feed finger 62, described hereinafter, and extends forwardly of the leading edge of support plate 46 so as to position feed finger 62 for engagement with the trailing edge of a sheet being transferred, as described more fully hereinafter.

Preferably, table plate 16 is provided with a plurality of longitudinally extending laterally narrow support strips 17 which slightly elevate a sheet being transferred so as to minimize frictional drag on the sheet and avoid any interference which might otherwise occur between the leading edge of the sheet and the forward ends of the openings 26 and 56.

Reciprocating feed finger unit T3 includes a support plate 64 extending laterally of the table beneath table plate 16 and forwardly of support plate 46 of transfer unit T2. The laterally opposite sides of support plate 64 are bolted or otherwise secured to bearing blocks 66 which, like bearing blocks 48, are longitudinally apertured to receive guide rods 50. Further, bearing sleeves 68 are interposed between the bearing blocks and corresponding guide rod to facilitate sliding movement of the bearing blocks therealong. Table plate 16 is provided with longitudinally extending openings 70 and 72, and feed bars 74 are bolted or otherwise secured to the upper side of support plate 64 and extend forwardly therefrom in the corresponding openings 70 and 72 to a location beyond the discharge end 20 of the table. Each feed bar 74 has an upper surface generally coplanar with the top surface of table plate 16, and each feed bar is provided with a plurality of feed fingers 76 by which a sheet is advanced step by step toward the discharge end of the table as set forth more fully hereinafter. The forward ends of feed bars 74 are suitably attached to a laterally extending support plate 78 which has its opposite sides bolted or otherwise fastened to bearing blocks 80. Bearing blocks 80 are longitudinally apertured to receive guide rods 50, and bearing sleeves 82 are interposed between bearing blocks 80 and guide rods 50 to facilitate sliding engagement of the bearing blocks therealong. Accordingly, it will be appreciated that support plate 78 maintains feed bars 74 in a desired laterally spaced relationship and supports the forward ends of the feed bars for reciprocating movement.

Reciprocating feed finger units T2 and T3 are reciprocated forwardly and rearwardly of table plate 16 simultaneously and, preferably, through a common drive unit. In the embodiment shown, the drive unit includes a rotary-to oscillating cam gear box 84, such as a well known commercially available Ferguson cam box. Cam box 84 is suitably mounted beneath table plate 16 and has a rotatable input shaft 86 and an oscillating output shaft 88. Support plates 46 and 64 of feed finger units T2 and T3 are reciprocated in response to oscillation of output shaft 88 through corresponding link trains therebetween. More particularly, as best seen in FIGS. 4–8 and with regard first to feed finger unit T2, a mounting block 90 is keyed or otherwise secured to output shaft 88 for oscillation therewith, and a first drive link 92 is bolted or otherwise attached to mounting block 90 and extends downwardly therefrom. A pair of links 94 have ends **94*a* thereof disposed on opposite sides of the lower end of link 92 and pivotally interconnected therewith such as by means of a pin 96. The opposite ends 94*b* of links 94 are disposed on opposite sides of the lower end of a link 98 and are pivotally interconnected therewith such as by means of a nut and bolt assembly 100. Link 98 extends vertically and is supported intermediate its opposite ends for pivotal movement about a horizontal axis. More particularly, a pair of support beams 102 extend between each pair of legs 12 and 14 of the table, and a support beam 104 extends laterally of the table between beams 102. A lever support bracket assembly 106 is mounted on beam 104 and includes a pair of arms 108 disposed on laterally opposite sides of link 98. Link 98 is pivotally interconnected with arms 108 such as by means of a nut and bolt assembly 110. The upper end of link 98 is disposed between corresponding ends of a pair of horizontally extending links 112 and is pivotally fastened thereto such as by means of a nut and bolt assembly 114. The opposite ends of links 112 are disposed on opposite sides of an arm 116 which is welded or otherwise secured to the under side of support plate 46, and links 112 and arm 116 are pivotally interconnected such as by means of a nut and bolt assembly 118. Accordingly, it will be appreciated that oscillating movement of output shaft 88 in the clockwise direction as viewed in FIG. 4 displaces support plate 46 and thus feed bars 60 toward input end 18 of the table, and that oscillating movement of shaft 88 counterclockwise displaces support plate 46 and feed bars 60 toward discharge end 20** of the table.

With regard now to feed finger unit T3, a second drive link 120 is bolted or otherwise fastened to mounting block 90 and extends upwardly from output shaft 88. A pair of horizontally extending links 122 have ends **122*a* disposed on oppotite sides of the upper end of drive link 120 and pivotally interconnected therewith such as by means of a nut and bolt assembly 124. The opposite ends of links 122 are disposed on opposite sides of an arm 126 welded or otherwise secured to the under side of support plate 64, and links 122 are pivotally interconnected with arm 126 such as by means of a nut and bolt assembly 128. Accordingly, it will be appreciated that oscillating movement of output shaft 88 clockwise as viewed in FIG. 4 displaces support plate 64 and thus feed bars 74 toward input end 18 of the table, and that oscillation of the output shaft in the counterclockwise direction displaces support plate 64 and feed bars 74 in the direction toward discharge end 20 of the table. It will be further seen that the linkage trains provide for support plates 46 and 64 and the corresponding feed bars to be reciprocated simultaneously and in the same direction in response to oscillation of output shaft 88. Moreover, the linkage dimensions and relationships provide for the displacement of plate 46 and feed bars 60 to be about three times that of plate 64 and feed bars 74**.

Figure 4:
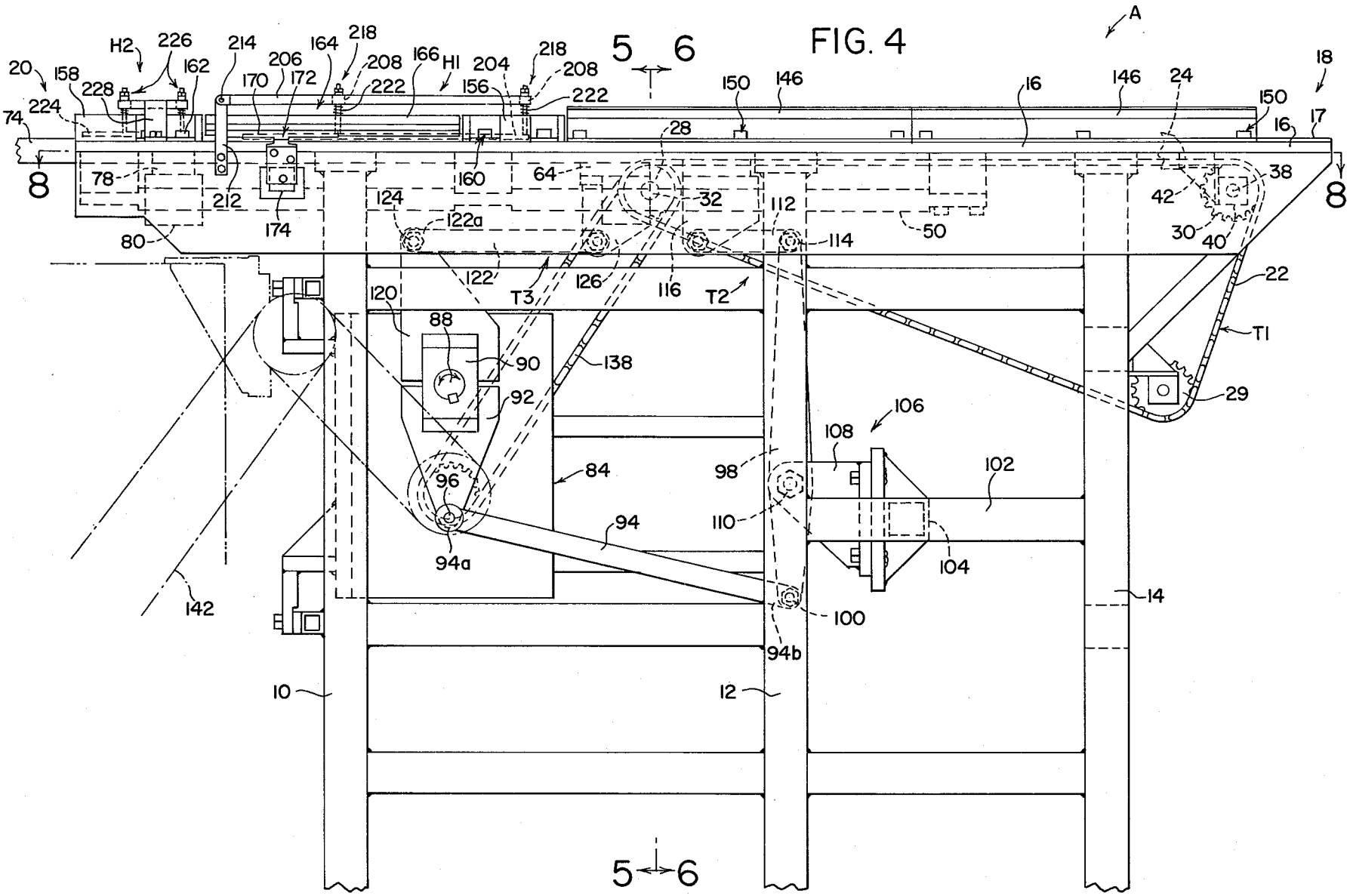
FIG. 4 is a side elevation view of the apparatus taken along line 4—4 in FIG. 3.
Figure 5:
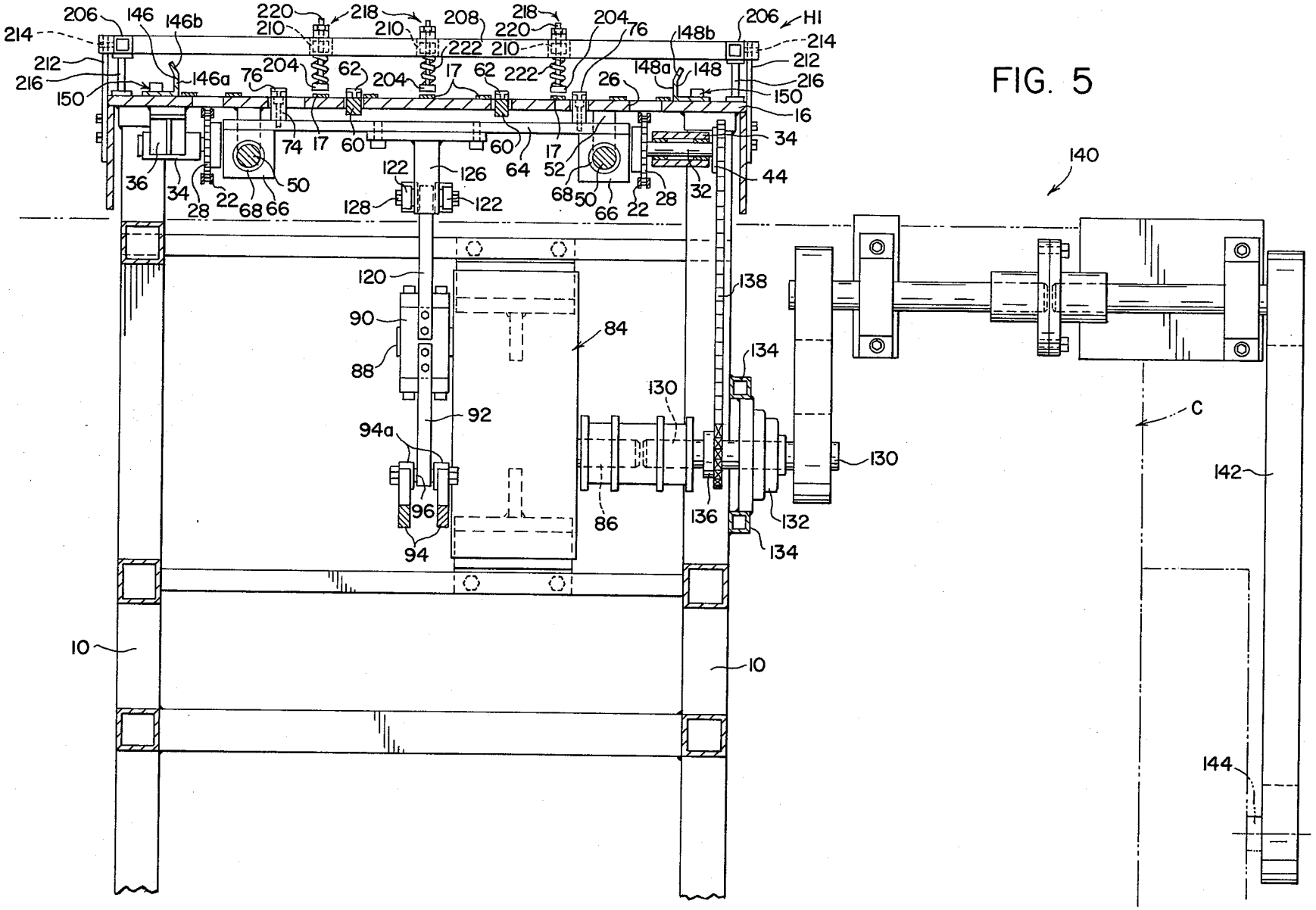
FIG. 5 is a cross-sectional elevation view of the apparatus taken along line 5—5 in FIG. 4.
Figure 7:
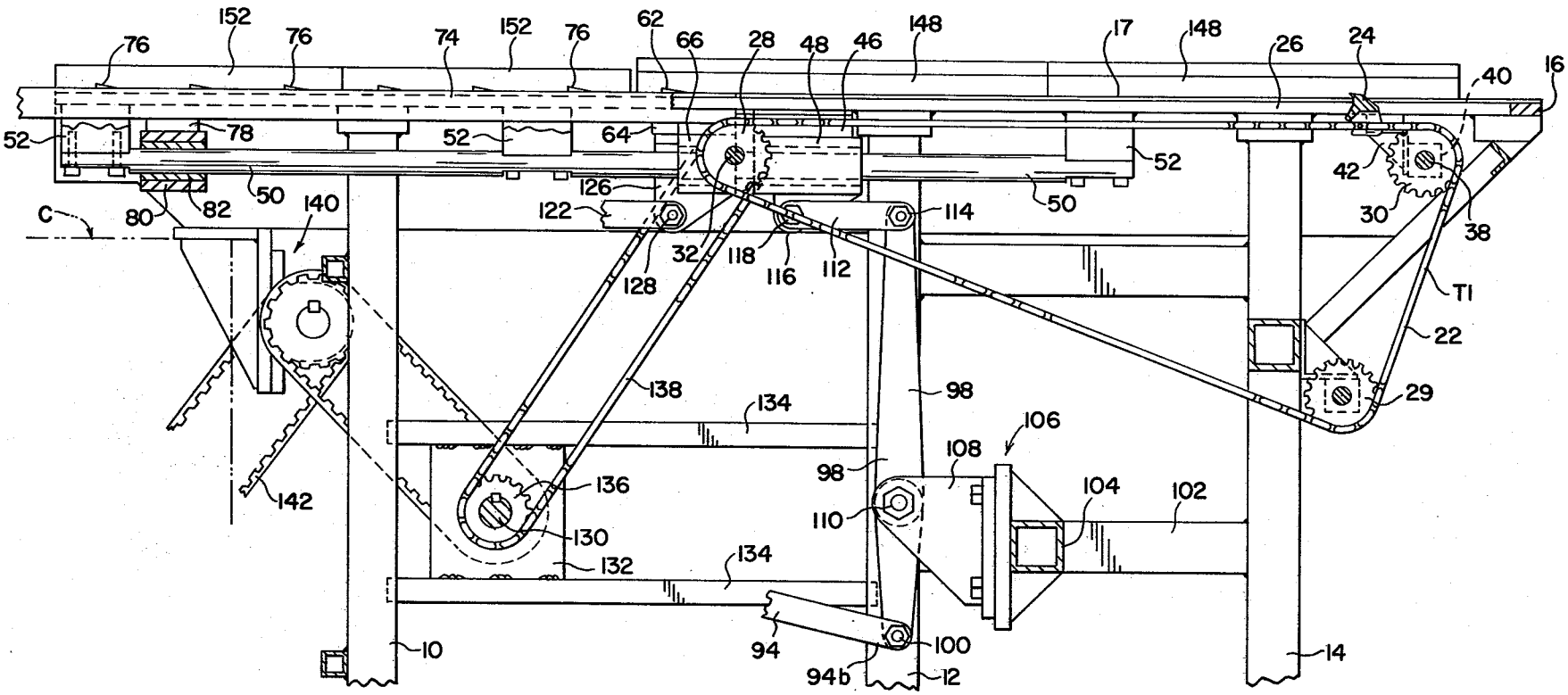
FIG. 7 is a cross-sectional elevation view taken along line 7—7 in FIG. 3.
Figure 8:
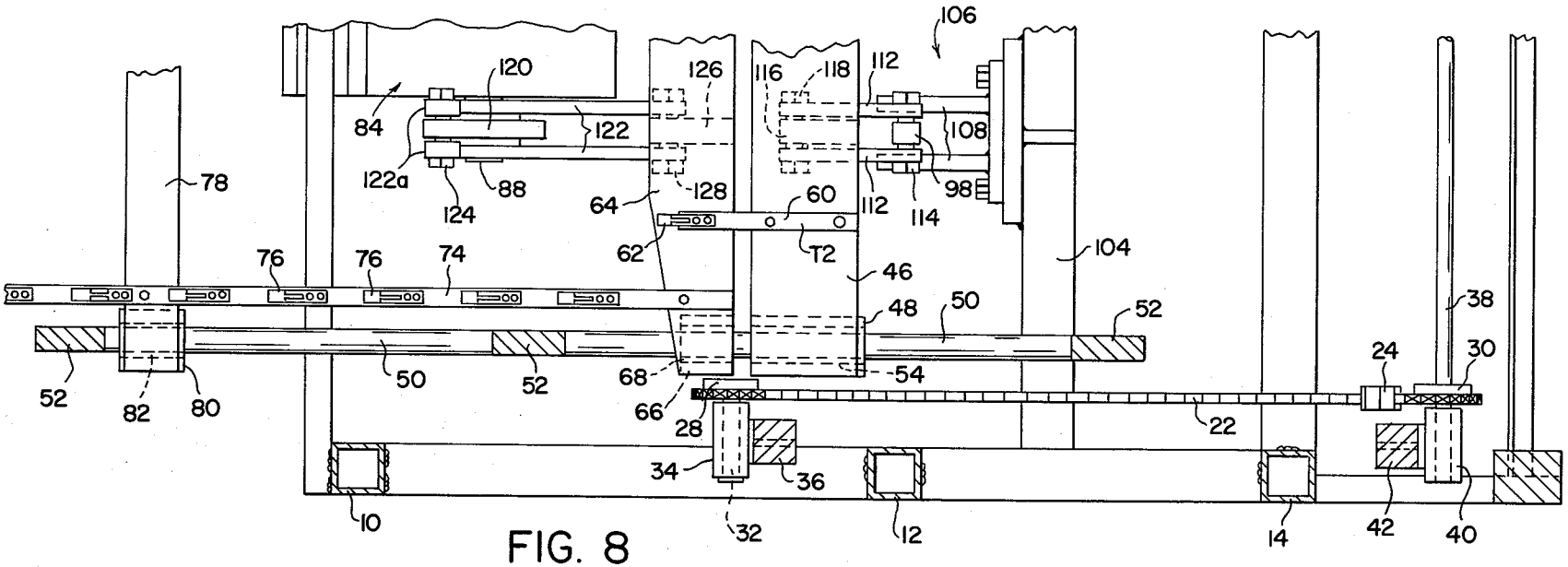
FIG. 8 is a plan view, in section, of the apparatus taken along line 8—8 in FIG. 4.

As will be seen from FIGS. 4, 5 and 7, input shaft 86 of cam box 84 is coupled with a driven shaft 130 supported for rotation by a bearing block assembly 132 mounted on the table by means of a pair of support beams 134 extending between legs 10 and 12 on the corresponding side of the table. Shaft 130 carries a sprocket wheel 136, and an endless chain 138 is trained about sprocket wheel 136 and sprocket wheel 44 of feed unit T1 so that the latter feed unit is driven in response to rotation of shaft 130. Preferably, feed units T1, T2 and T3 are driven by the press so as to be coordinated with reciprocation of the press slide and, in the embodiment shown, this is achieved through a drive train assembly designated generally by the numeral 140 and which includes a belt 142 driven by a take-off shaft 144 from the press.

As seen in FIGS. 3–7, the opposite sides of table plate 16 are provided with longitudinally extending guide bars 146 and 148 which extend from input end 18 of the table to a location adjacent the forward edge of the corresponding opening 26 for the endless belt of feed unit T1. Guide bars 146 and 148 include corresponding vertical walls **146*a* and 148*a* extending upwardly from the top surface of table plate 16 and outwardly flared top portions 146*b* and 148*b*. Each guide bar is interconnected with the table by means of a plurality of slot and fastener arrangements 150 which enable lateral adjustment of the guide bars relative to one another. Guide bars 146 and 148 provide initial guidance for a sheet deposited on the input end of the table as it is transferred forwardly of the table by feed unit T1. Accuracy of guidance during initial transfer of the sheet is not necessary and in fact is avoided in favor of increasing the speed with which the sheet can be deposited on the table and initially transferred to a position in which the trailing edge thereof is adjacent the forward ends of belt openings 26. The outwardly flared top portions 146*b* and 148*b* of the guide bars facilitates guidance of a sheet deposited on the table to a position between guide bars 146 and 148 and, since accuracy of guidance of initial transfer of the sheet along the table is not necessary, feed fingers 24** of transfer unit T1 engage the trailing edge of the sheet and quickly transfer it forwardly of the table. This advantageously avoids delays heretofore encountered in connection with the necessity to accurately position a sheet on the transfer table upon delivery of the sheet thereto by a mechanical de-stacker.

The side of the table supporting guide bars 148 is further provided with guide bars 152 which extend from the forward ends of openings 26 to discharge end 20 of the table. Guide bars 152 are mounted on the table by corresponding slot and fastener arrangements 154 which enable lateral adjustment of the guide bars relative to the table. Guide bars 152 are laterally fixed to provide accurate lateral positioning of the sheet for subsequent transfer to the press. The opposite side of the table is provided with short guide bars 156 and 158 which are mounted on the table by corresponding slot and fastener arrangements 160 and 162. Guide bars 152, 156 and 158 operate in conjunction with guide bars 146 and 148 to initially guide movement of the sheet forwardly of the table and, as mentioned hereinabove, upon completion of the transfer by feed unit T1 the trailing edge of the sheet is disposed adjacent the forward ends of belt openings 26. At this point, the trailing edge of the sheet is positioned to be engaged by feed fingers 62 of feed unit T2, whereby forward movement of support plate 46 of the latter feed unit displaces the sheet and the trailing edge thereof forwardly of the table a distance corresponding to the stroke of plate 46. This displacement by feed unit T2 accurately positions the sheet longitudinally of the table with respect to reference point P of the press. When so positioned longitudinally, a laterally reciprocable guide bar assembly 164 is actuated to displace the sheet laterally toward the other side of the table and against fixed guide bars 152.

Figure 3:
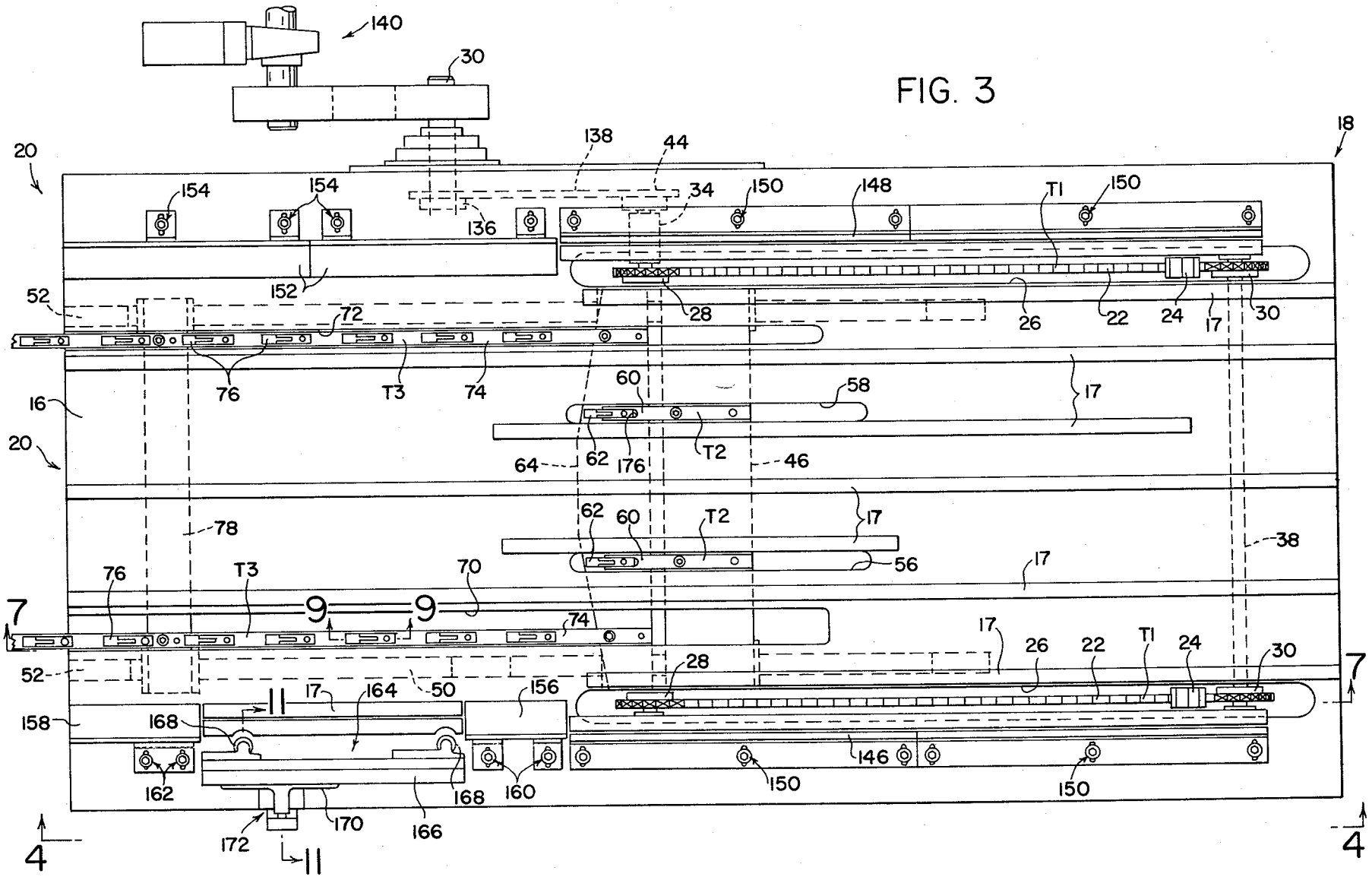
FIG. 3 is a plan view of the sheet transfer apparatus taken along line 3—3 of FIG. 1.
Figure 11:
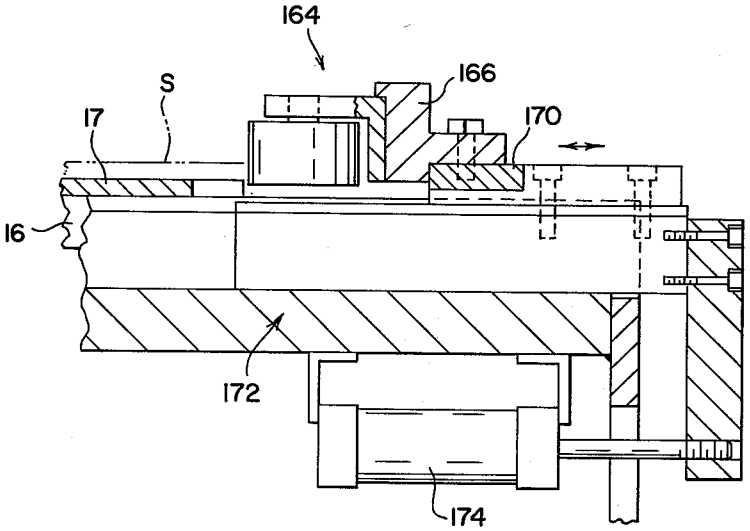
FIG. 11 is a detailed cross-sectional elevation view of the lateral alignment unit of the apparatus taken along line 11—11 in FIG. 3.

Guide bar assembly 164, as best seen in FIGS. 3, 4 and 11, includes a longitudinally extending support member 166 carrying a pair of longitudinally spaced apart rollers 168. Support member 166 is bolted or otherwise fastened to a carrier plate 170 which is supported by a guideway assembly 172 for reciprocating movement laterally of the table. Reciprocating movement is achieved by means of a pneumatic piston and cylinder type motor 174 having a piston rod suitably interconnected with carrier 170 for this purpose. Rollers 168 are adapted to engage the corresponding side of a sheet S on the table in response to displacement of guide bar unit 164 inwardly of the table, thus to firmly engage the opposite side edge of the sheet with fixed guide bars 152. This accurately aligns the sheet laterally with respect to reference point P of the press. Inward displacement of guide bar unit 164 is maintained during subsequent advancement of the sheet forwardly of the table in order to maintain the desired lateral guidance, and rollers 168 facilitate advancement of the sheet with the pressure applied thereagainst by guide bar unit 164.

When the trailing edge of the sheet has been advanced a distance corresponding to the stroke of support plate 46 of feed unit T2 as mentioned above, the trailing edge is positioned to be engaged by the rearmost pair of feed fingers 76 of feed unit T3. Thus, upon forward movement of support plate 64 of feed unit T3 the sheet is advanced a step corresponding to the stroke of the support plate. Rearward movement of support plate 64 then positions the next pair of feed fingers behind the trailing edge of the sheet for the next forward stroke of the support plate to advance the sheet one more step. Feed fingers 76 of feed unit T3 are accurately spaced apart longitudinally of the corresponding feed bar a distance which provides for each step to position the sheet longitudinally of press reference point P such that the ensuing press stroke cuts a blank from the sheet with minimum wastage of material between the cut blank and the preceding cut blank. It will be appreciated that the number of feed fingers 76 and the longitudinal spacing thereof is determined by the length of the sheets being transferred and the size of the blank being punched from the sheet by the press.

With further regard to the feed bars and feed fingers of transfer units T2 and T3, the preferred structures thereof are best seen in FIGS. 3, 9 and 10. In this respect, the forward ends of feed bars 60 of feed unit T2 are provided with longitudinally extending recesses 176 opening forwardly of the feed bar and receiving feed fingers 62, as shown in FIG. 3. Feed bars 74 of feed unit T3 are each provided with a plurality of longitudinally spaced apart recesses 178 each receiving a corresponding feed finger 76. The feed finger receiving recess at the outermost end of each feed bar 74 opens forwardly of the feed bar in a manner similar to that of recess 176 of feed bars 60. Feed fingers 62 and 76 are identical in structure and operation. Accordingly, it will be understood that the following description of one of the feed fingers 76 is applicable to the others.

As best seen in FIGS. 9 and 10, feed finger 76 includes a body portion 180 having a leading end provided with a longitudinally extending recess 182 to receive a finger element 184. Further, body portion 180 has a trailing end provided with a longitudinal recess 186 to receive a pair of studs 188 by which the feed finger is mounted in recess 178 of feed bar 74. Finger element 184 is mounted on body 180 for pivotal movement by means of a pin 190 and is provided with a nose element 192 to engage the trailing edge of a sheet during advancement of the sheet by the feed finger. A biasing spring 194 urges nose 192 upwardly so that the nose is normally disposed above the planar top surface 196 of body 180. Further, finger element 184 has a planar top surface 198 which is coplanar with surface 196 when nose 192 of the finger element is displaced downwardly into the recess.

The bottom surface of finger element 184 includes a front portion 200 parallel with top surface 198 and providing a stop for downward movement of nose 192, and a rear portion 202 inclined with respect to portion 200 and adapted to engage the bottom of recess 182 to limit upward movement of nose 192. It will be appreciated that during initial transfer of a sheet by feed unit T1 the sheet passes over feed fingers 62 and 76 thus displacing the noses thereof downwardly into the corresponding recess 182. When advancement of the sheet by feed unit T1 is completed, springs 194 bias noses 192 of feed fingers 62 upwardly behind the trailing edge of the sheet upon movement of support plate 46 of feed unit T2 to its rearward most position. Thus, feed fingers 62 are positioned to engage the trailing edge and advance the sheet during forward movement of support plate 46. Similarly, each forward stroke of support plate 64 of feed unit T3 advances the sheet one step and the ensuing rearward stroke of the support plate releases the next pair of feed fingers 76 for upward movement under the bias of the corresponding springs 94 when the noses of the fingers move rearwardly beyond the trailing edge of the sheet.

As mentioned hereinabove, accuracy with regard to advancement of the sheet by feed units T2 and T3 is enhanced by spring biased hold down assemblies H1 and H2. As best seen in FIGS. 4 and 5, hold down assembly H1 overlies feed unit T3 and includes a plurality of longitudinally extending hold down bars 204 each overlying a corresponding one of the longitudinally extending wear strips 17. Hold down bars 204 are supported by a frame structure including longitudinally extending frame pieces 206, laterally extending frame pieces 208, and frame pieces 210 extending longitudinally between frame pieces 208. The several frame members are suitably interconnected such as by welding, and the frame is pivotally interconnected with the table at one end of the frame by bracket assemblies 212 mounted on the table sides and interconnected with frame pieces 206 by means of pins 214. The other end of the frame assembly is releaseably attached to the table by means of posts 216 having their upper ends welded to the corresponding frame piece 206 and their bottom ends bolted or otherwise releaseably attached to table plate 16.

Each hold down bar 204 is adjustably mounted on the frame assembly by means of a pair of spring and bolt assemblies 218 each including a bolt 220 having its lower end suitably fixed to the corresponding hold down bar and having its upper end extending through the corresponding frame piece 208 and threaded to receive a pair of nuts which enable adjustment of the position of the hold down bar above the underlying wear strip 17. A coil spring 222 surrounds each bolt 220 between frame piece 208 and the corresponding hold down bar 204, and accordingly biases the hold down bar toward the underlying wear strip so that a sheet S captured therebetween is held down under a predetermined and adjustable pressure.

The second hold down assembly H2 is disposed forwardly of hold down assembly H1 adjacent discharge end 20 of the table and is structurally similar to hold down assembly H1. In this respect, as will be understood from FIG. 4, hold down assembly H2 includes a frame assembly supporting a plurality of longitudinally extending hold down bars 224 each longitudinally aligned with a corresponding one of the hold down bars 204 of assembly H1. Each hold down bar 224 is adjustably mounted on the frame of hold down assembly H2 by means of a pair of longitudinally spaced apart adjustable bolt and spring assemblies 226 including bolt and spring components corresponding to bolts 220 and springs 222 of assembly H1 and associated with the frame of assembly H2 in the same manner described hereinabove with regard to assembly H1. Hold down assembly H2 is supported relative to table A by means of brackets 228 bolted or otherwise secured to the table adjacent laterally opposite sides thereof and to the upper ends to which the frame of the hold down assembly is rigidly secured.

Figure 12:
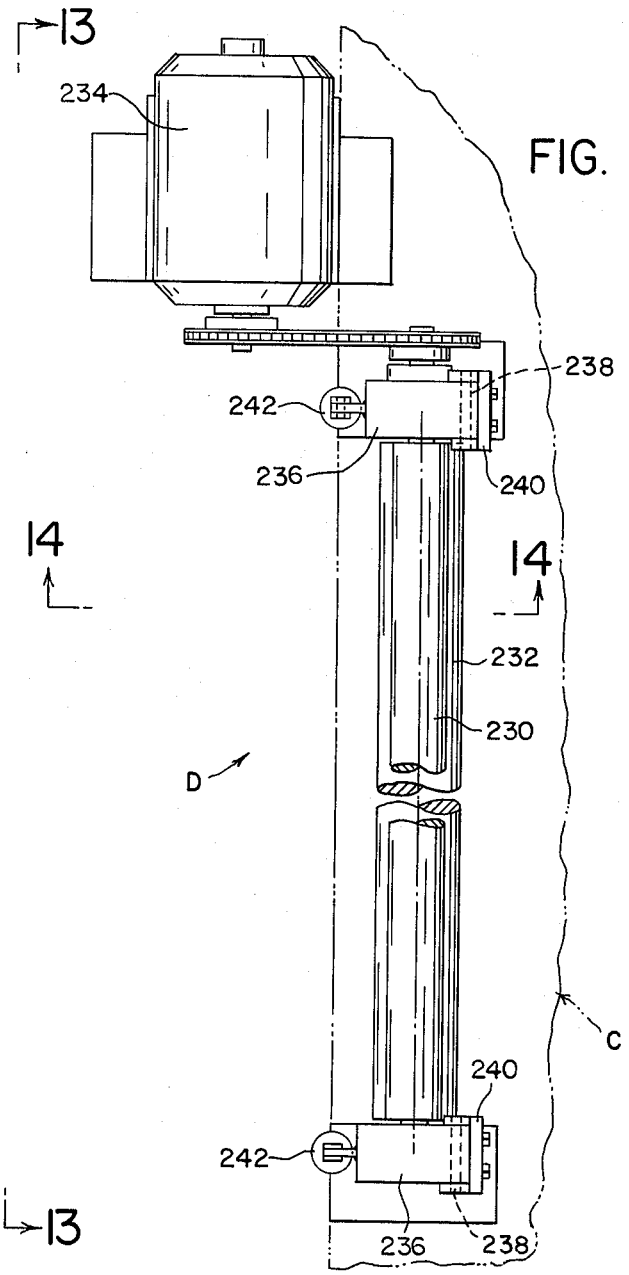
FIG. 12 is a plan view of the scrap discharge unit of the apparatus taken along line 12—12 in FIG. 1.
Figure 14:
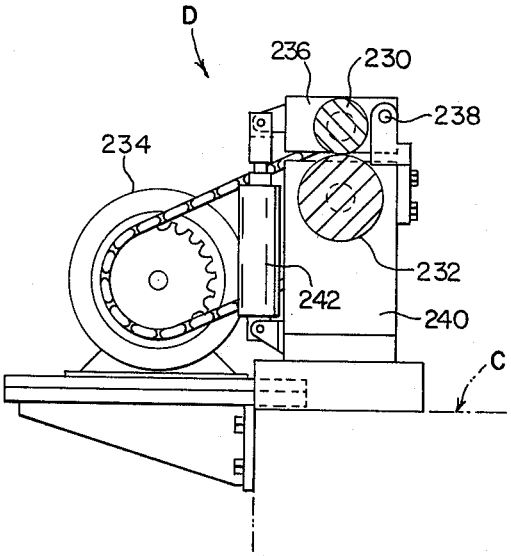
Figure 13:
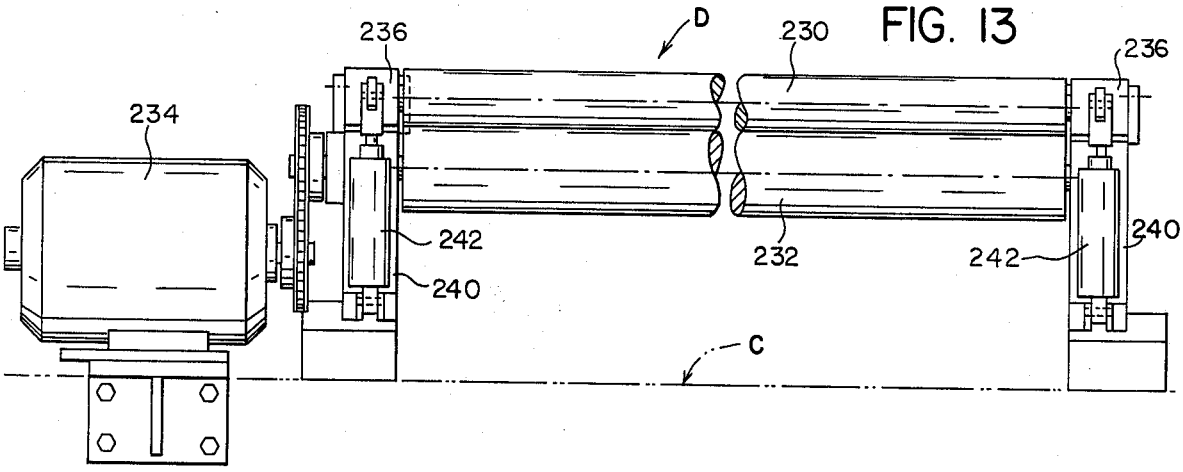
FIG. 13 is an end elevation view of the discharge unit taken along line 13—13 in FIG. 12; and, FIG. 14 is a cross-sectional elevation view of the discharge unit taken along line 14—14 in FIG. 12.

When a given sheet has been advanced the last step toward the press by the forwardmost feed fingers 76 of feed unit T3, the leading edge of the scrap material enters between the rolls of discharge unit D and, following the last press stroke with respect to the sheet, is quickly discharged therefrom by unit D. More particularly, as best seen in FIGS. 12–14, discharge assembly D includes upper and lower rolls 230 and 232, respectively, the nip of which is aligned to receive the leading edge of the scrap material issuing from the press. Lower roll 232 is driven by a suitable motor 234, and the upper roll is adapted to be driven through engagement with lower roll 232 or metal scrap material therebetween. Upper roll 230 is adapted to be vertically spaced from roll 232 when the leading edge of the scrap material reaches the rolls. For this purpose upper roll 230 has its opposite ends mounted in bearing blocks 236 each of which is pivotally interconnected by means of a pin 238 with the corresponding roll support frame member 240. Piston and cylinder type air motors 242 are provided at each end of roll 230 and have their cylinders pivotally connected to the corresponding roll frame 240. The outer ends of the pistons of motors 242 are pivotally connected with the corresponding bearing block 236. Upon extension of the piston rods, bearing blocks 236 are pivoted about pins 238 to raise upper roll 230 out of engagement with roll 232. This is the normal position of rolls 230 and 232 prior to a scrap discharge function. When the leading edge of the scrap sheet enters the space between rolls 230 and 232, air motors 242 are actuated to retract the corresponding piston rod, whereby upper roll 230 descends and the scrap sheet is displaced by the engagement thereof between the rolls. This enables the scrap material to be quickly discharged from the press so as not to interfere with the infeed of the succeeding sheet to be punched.

In operation of the apparatus thus described, a metal sheet to be blanked in a press is deposited on the input end of the feed table somewhat randomly and with the trailing edge forwardly of the input end sufficiently to be engaged by feed fingers 24 of feed unit T1. Feed unit T1 is constantly driven and, accordingly, the sheet is quickly advanced to a position in which the trailing edge is adjacent the forward ends of openings 26. The trailing edge of the sheet is then engaged by feed fingers 62 of feed unit T2 and by forward movement of support plate 46 is advanced one step to accurately longitudinally align the sheet relative to the reference point of the press. The ensuing return movement of support plate 46 and support plate 64 of feed unit T3 positions the rearwardmost feed fingers 76 of feed unit T3 behind the trailing edge of the sheet. During such rearward displacement of support plate 64 side guide unit 164 is displaced laterally inwardly of the table to displace the sheet laterally into engagement with fixed guide bars 152 and 154 to laterally align the sheet relative to the reference point of the press. Actuation of guide unit 164 can be in response to a suitable control signal such as, for example, a signal generated in response to movement of the leading edge of the sheet into the position thereof determined by advancement of the sheet by feed unit T2.

The succeeding forward and reverse strokes of support plate 64 of feed unit T3 results in accurate step by step advancement of the sheet through the press until the trailing edge is engaged and the sheet advanced forwardly by the last pair of fingers 76 of feed unit T3. At this time, the leading edge of the scrap material is positioned between the open rolls 230 and 232 of discharge unit D and, following the stroke of the press making the last cut on the sheet, a suitable signal is provided to actuate air motors 242 to close the rolls and achieve discharge of the scrap sheet. Such a signal can be generated, for example, in response to the press making a predetermined number of strokes corresponding to the number of blanking operations to be performed during movement of the press. Such a timed signal can also be employed to cause the delivery of a succeeding sheet onto the input end of the feed table when the preceding sheet is sufficiently advanced through the press to assure against interference between the sheets. Such control functions and the manner in which they are achieved are of course well within the skill of the art and accordingly need not be further described in detail herein.

As many possible embodiments of the present invention can be made, and as many changes can be made in the embodiment herein illustrated and described, it is to be distinctly understood that the foregoing descriptive matter is to be interpreted merely as illustrative of the present invention and not as a limitation.

What is claimed is:

1. Sheet transfer apparatus comprising table means providing support surface means for a sheet to be transferred to a work station having a reference point, said table means having first and second ends, the direction of transfer being longitudinally of said table means from said first end toward said second end, said sheet having laterally spaced apart side edges and leading and trailing edges providing a length in said direction of transfer, first, second and third feed means supported by said table means and providing three sequential intermittent stages of advancement for a sheet in said direction along said surface means, said first feed means including means to advance said sheet continuously in said direction a distance at least equal to said sheet length and from a first position to a second position on said table means, said second feed means including means to advance said sheet just one step in said direction and a distance less than said sheet length and from said second position to a third position on said table means in which said sheet is longitudinally aligned with said reference point, laterally spaced apart relatively displaceable guide means on said table means at said third position, means to displace said guide means to engage said side edges of said sheet to laterally align said sheet in said third position with respect to said reference point, said third feed means including means to intermittently advance said sheet only in said direction and in equal steps each of less distance than said one step, said third feed means advancing said sheet relative to said reference point and from said third position to a fourth position in which said trailing edge is adjacent said reference point, and means to drive said feed means.

2. Sheet transfer apparatus according to claim 1, wherein said second and third feed means each include plate means supported by said table means for reciprocation in the direction between said first and second ends of said table means, each said plate means carrying finger means to engage said trailing edge of said sheet to advance said sheet in said direction of transfer, said means to drive said feed means including means to reciprocate said plate means simultaneously in the same direction.

3. Sheet transfer apparatus according to claim 2, wherein said first feed means includes endless belt means underlying said support surface means and carrying means to engage said trailing edge of said sheet to advance said sheet from said first to said second position.

4. Sheet transfer apparatus according to claim 3, wherein said finger means carried by said plate means for said third feed means is a plurality of sets of fingers, the fingers in each set being laterally spaced apart and the sets of said plurality being spaced apart in said direction of transfer.

5. Sheet transfer apparatus according to claim 4,wherein said means to reciprocate said plate means includes shaft means, means to oscillate said shaft means, and corresponding link means interconnecting said shaft means and each plate means to transform said shaft oscillation to reciprocation of said plate means.

6. Sheet transfer apparatus according to claim 5, and hold down means on said table means ahead of said first position in said direction of transfer and including means biasing said sheet against said support surface means.

7. Sheet feeding apparatus comprising table means providing support surface means for a sheet to be transferred to a work station having a reference point, said table means having longitudinally opposite ends, driven endless belt means supported by said table means adjacent one of said ends and including feed finger means movable by said belt means in the direction from said one end of said table means toward the other to transfer a sheet on said support surface means in said direction from a first position to a second position in which said sheet is at rest, first plate means supported by said table means for reciprocation longitudinally thereof and including just one set of laterally spaced apart first feed fingers movable therewith to engage and transfer said sheet just one step of a first distance in said direction and from said second position to a third position in which said sheet is at rest and longitudinally aligned with respect to said reference point, first and second guide means supported by said table means in laterally spaced apart relationship to receive said sheet therebetween when said sheet is in said third position, said guide means being cooperable to align said sheet laterally with respect to said reference point, second plate means supported by said table means for reciprocation longitudinally thereof and including a plurality of sets of laterally spaced apart second feed fingers movable therewith and equally spaced apart longitudinally for a different one of said plurality to engage and transfer said sheet a second distance in said direction each cycle of reciprocation of said second plate means, a first shaft, means interconnecting said first shaft with said first and second plate means to simultaneously reciprocate said first and second plate means in response to oscillation of said first shaft and for said first distance to be greater than each said second distance, and means including common drive means for driving said belt means and oscillating said first shaft.

8. Sheet feeding apparatus according to claim 7, wherein said means interconnecting said first shaft with said first and second plate means includes arm means attached to said first shaft for oscillation therewith, said arm means having opposite ends each spaced from said first shaft, first link means pivotally interconnecting one of said opposite ends of said arm means with said first plate means, and second link means pivotally interconnecting the other of said opposite ends with said second plate means.

9. Sheet feeding apparatus according to claim 7, wherein said means to oscillate said first shaft includes a driven rotatable shaft and means to transform rotation of said driven shaft to oscillation of said first shaft, and said means to drive said belt means includes means interconnecting said driven shaft and endless belt means for said belt means to be driven by said driven shaft.

10. Sheet transfer apparatus according to claim 9, and hold down means on said table means ahead of said first position in said direction of transfer and including means biasing said sheet against said support surface means.

11. Sheet feeding apparatus according to claim 10, wherein said first guide means is fixed and said second guide means is laterally reciprocable toward and away from said first guide means, and means to reciprocate said second guide means.

12. Sheet feeding apparatus according to claim 11, and discharge roll means spaced from said other end of said table means and including a pair of parallel rolls to receive said sheet therebetween, said plurality of second feed fingers transferring said sheet from said third position to said roll means, means to displace said rolls relative to one another between open and closed positions, and means to rotate one of said rolls for said rolls in the closed position to transfer a sheet delivered thereto by said second feed finger means.

* * * * *